US007007760B2

(12) United States Patent
Lohbeck

(10) Patent No.: US 7,007,760 B2
(45) Date of Patent: Mar. 7, 2006

(54) METHOD OF EXPANDING A TUBULAR ELEMENT IN A WELLBORE

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 198 days.

(21) Appl. No.: 10/483,657

(22) PCT Filed: Jul. 10, 2002

(86) PCT No.: PCT/EP02/07882

§ 371 (c)(1),
(2), (4) Date: Jan. 12, 2004

(87) PCT Pub. No.: WO03/006788

PCT Pub. Date: Jan. 23, 2003

(65) Prior Publication Data

US 2004/0173361 A1 Sep. 9, 2004

(30) Foreign Application Priority Data

Jul. 13, 2001 (EP) ..... 01306050

(51) Int. Cl.
*E21B 43/10* (2006.01)

(52) U.S. Cl. ..... 166/384; 166/207

(58) Field of Classification Search ..... None
See application file for complete search history.

(56) References Cited

U.S. PATENT DOCUMENTS

| | | | | |
|---|---|---|---|---|
| 3,203,483 | A | 8/1965 | Vincent | |
| 3,669,190 | A * | 6/1972 | Sizer et al. | 166/387 |
| 5,348,095 | A | 9/1994 | Worrall et al. | |
| 6,561,227 | B1 * | 5/2003 | Cook et al. | 138/98 |
| 6,568,472 | B1 * | 5/2003 | Gano et al. | 166/207 |

FOREIGN PATENT DOCUMENTS

| | | | |
|---|---|---|---|
| SU | 1745873 | A1 * | 7/1992 |
| WO | 99/35368 | | 7/1999 |

OTHER PUBLICATIONS

International Search Report dated Oct. 23, 2002.

* cited by examiner

*Primary Examiner*—Zakiya Walker

(57) ABSTRACT

There is provided a method of radially expanding a tubular element extending into a wellbore, the tubular element having a first section to be expanded to a first diameter and a second section to be expanded to a second diameter, the first diameter being larger than the second diameter. The method involves arranging an expander in the wellbore, the expander including a first expander member and a second expander member, wherein the first member has a larger outer diameter than the second member, said members being releasably interconnected. The expander is moved through the first tubular section thereby expanding the first tubular section to the first diameter, whereafter the second expander member is released from the first expander member. The second expander member is then moved through the second tubular section so as to expand the latter to the second diameter.

8 Claims, 4 Drawing Sheets

METHOD OF EXPANDING A TUBULAR ELEMENT IN A WELLBORE

FIELD OF THE INVENTION

The present invention relates to a method of radially expanding a tubular element extending into a wellbore, the tubular element having a first section to be expanded to a first diameter and a second section to be expanded to a second diameter, the first diameter being larger than the second diameter. The tubular element can be, for example, part of a string of wellbore casing with casings or liners having axially overlapping portions.

BACKGROUND OF THE INVENTION

WO 99/35368 discloses a method of radially expanding a string of casing whereby adjacent casings have such axially overlapping portions. In the known method a first casing is lowered into the wellbore and radially expanded by means of an expander mandrel. A second casing is then lowered through the expanded first casing until an upper end part of the second casing is positioned in a lower end part of the first casing. The second casing is subsequently expanded to substantially the same inner diameter as the first casing.

It is a drawback of the known method that the expansion forces required to expand the upper end part of the second casing are very high because, simultaneously with expanding said upper end part, the lower end part of the first casing is to be expanded further. In case the first casing has already been cemented in place, subsequent expansion becomes even more difficult.

In accordance with the invention there is provided a method of radially expanding a tubular element extending into a wellbore, the tubular element having a first section to be expanded to a first diameter and a second section to be expanded to a second diameter, the first diameter being larger than the second diameter, the method comprising:

a) arranging an expander in the wellbore, the expander including a first expander member and a second expander member, wherein the first member has a larger outer diameter than the second member, said members being releasably interconnected;
b) moving the expander through the first tubular section so as to expand the first tubular section to the first diameter;
c) disconnecting the second expander member from the first expander member; and
d) moving the second expander member through the second tubular section so as to be expanded to the second diameter.

It is thereby achieved that the tubular element is expanded to sections of different diameters without having to expand overlapping portions of adjacent tubular elements simultaneously, so that the required expansion forces remain within acceptable limits. It is a further advantage of the method of the invention that the tubular element can be cemented in place before further drilling of the wellbore.

In order to allow the expansion process to be carried out by pulling the expander upwardly through the tubular element, it is preferred that the first tubular section is a lower end part of the tubular element, and the second tubular section is the remaining part of the tubular element.

SUMMARY OF THE INVENTION

In a preferred embodiment of the method of the invention, the tubular element is a previous tubular element and the tubular string includes a next tubular element, wherein the method further comprises: e) after step d) lowering the next tubular element through the previous tubular element until an upper end part of the next tubular element is arranged in the lower end part of the previous tubular element; and f) expanding said upper end part of the next tubular element so as to become sealingly arranged in the lower end part of the previous tubular element.

BRIEF DESCRIPTION OF THE DRAWINGS

The invention will be described hereinafter in more detail and by way of example with reference to the accompanying drawings in which:

Referring to FIGS. 1A and 2 there is shown an expander 1 for radially expanding a tubular element, the expander 1 including first and second expander members whereby the second member is a main body 3 of the expander 1 and the first member is an expander ring 4 surrounding part of the main body 3. The main body 3 has a nose section 6, a frustoconical section 8, and a rear section 10, whereby the nose section 6 is of a diameter substantially equal to the inner diameter of the tubular elements (referred to hereinafter) to be expanded before expansion thereof. The rear section 10 is of a diameter larger than the nose section 6 so as to be suitable to expand each tubular element to a second inner diameter D2. The frustoconical section 8 forms a transition between the nose section 6 and the rear section 10. A connector 11 is provided at the top of the nose section 6 for connection of the expander 1 to a pulling string (referred to hereinafter).

Figure 1A:
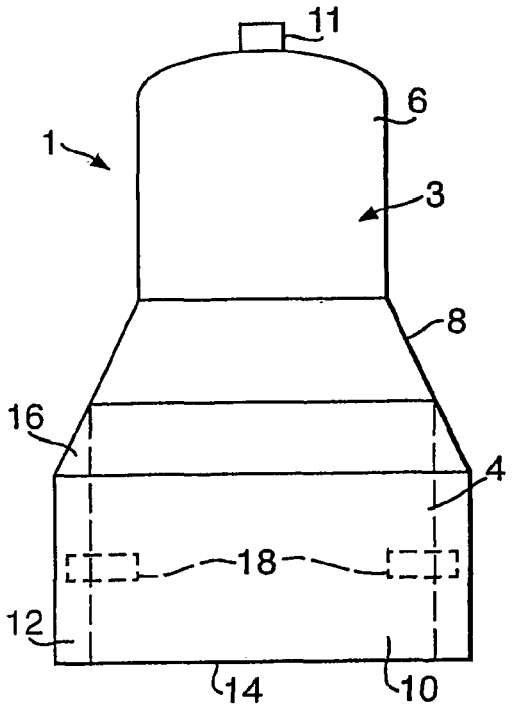
FIG. 1A schematically shows a side view of an expander used in an embodiment of the method of the invention, with first and second expander members interconnected.

The expander ring 4 extends around the rear section 10 and around part of the frustoconical section 8 of the main body 3, which expander ring 4 has an outer diameter larger than the diameter of the rear section 10 so as to be suitable to expand each tubular element to a first inner diameter D1 which is larger than D2. One end part 12 of the expander ring 4 is axially aligned with the rear end 14 of the main body 3, and the other end part 16 of the expander ring is tapered so as to form a continuation of the frustoconical section 8 of the main body 3. The expander ring is releasably connected to the main body 3 by means of a latching system 18 which is arranged to unlatch the ring 4 from the main body 3 by hydraulic control means (not shown) incorporated in the main body 3.

DETAILED DESCRIPTION OF THE INVENTION

Figure 1B:
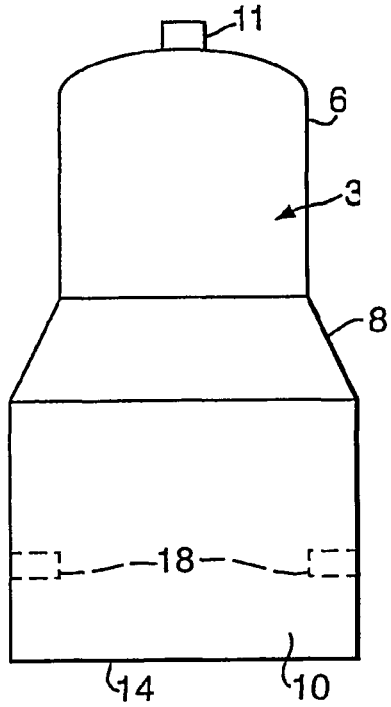
FIG. 1B schematically shows the second member of the expander of FIG. 1.
Figure 2:
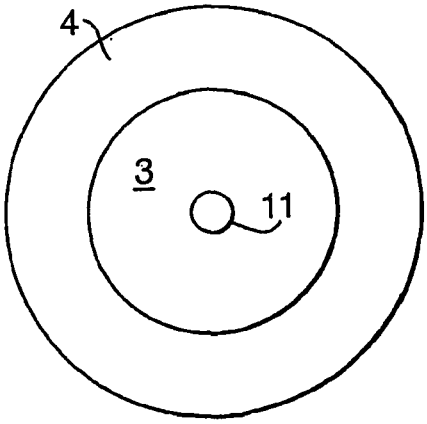
FIG. 2 shows a bottom view of the expander of FIG. 1A.

In FIG. 1B is shown the main body 3 of the expander 1 with the expander ring 4 removed therefrom.

Figure 3:
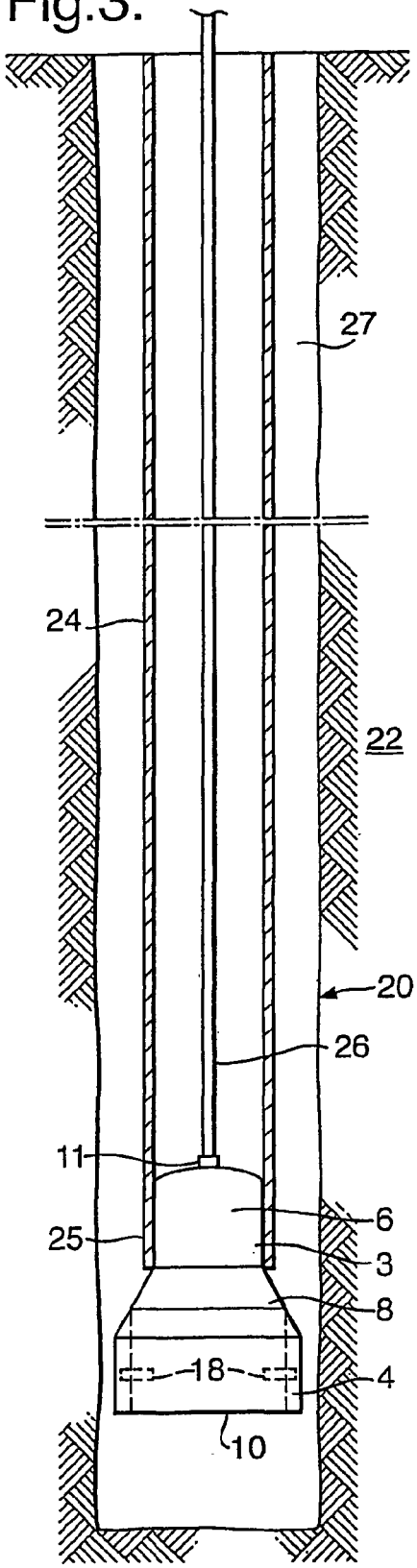
FIG. 3 schematically shows a first stage of the method of expanding a tubular string using the expander of FIG. 1A.

FIG. 3 shows a wellbore 20 drilled into an earth formation 22 and a tubular element in the form of casing 24, which has been lowered into the wellbore 20. The casing 24 has a lower end part 25 at which the expander 1 is arranged in a manner that the nose section 6 of the expander extends into said lower end part 25. A pulling string 26 is connected to the expander 1 by means of connector 11 to hold the expander in this position relative to the casing 24. The pulling string 26 has a longitudinal fluid passage (not shown) providing fluid communication between a hydraulic control system (not shown) at surface and the hydraulic control means of the latching system 18.

Figure 4:
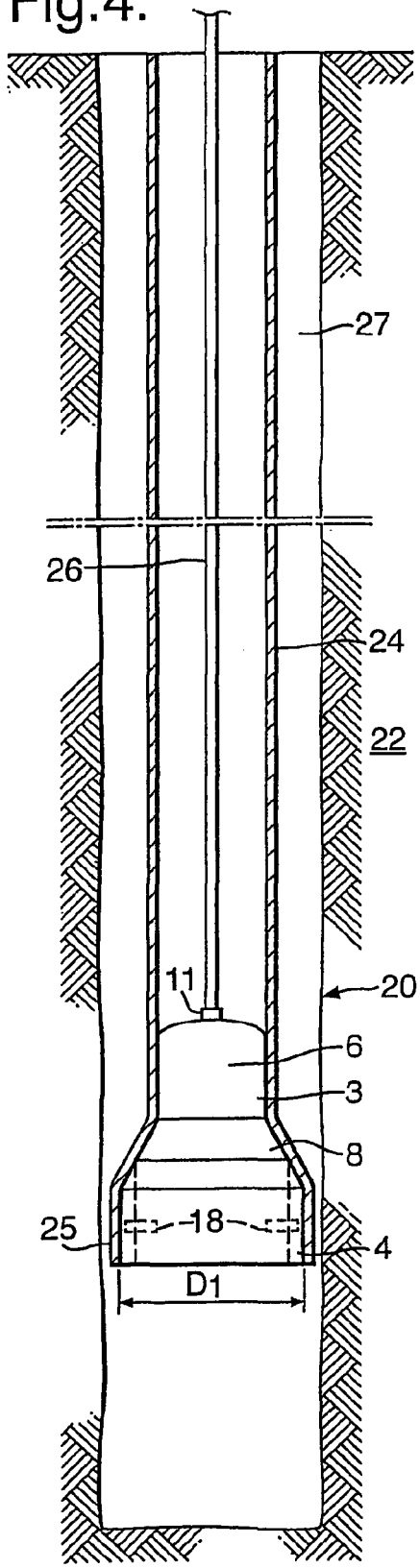
FIG. 4 schematically shows a second stage of the method of expanding a tubular string using the expander of FIG. 1A.

Reference is further made to FIG. 4. After the expander 1 has been lowered to the required depth, cement is pumped into the annular space 27 between the casing 24 and the wall of the wellbore 20. An excess amount of cement is used in view of dropping of the initial cement level when the work-string used to pump cement in the annular space, is closed and removed. The cement is of a composition such that hardening of the cement occurs only after a prolonged period of time.

Subsequently the expander 1 is pulled into the casing 24 a short distance which is considered suitable for longitudinal overlap of the casing 24 with a next casing (referred to hereinafter). In FIG. 4 such distance is shown substantially equal to the length of the expander ring 4, however different distances can be selected in accordance with operational requirements. By pulling the expander 1 into the casing 24 the lower end part 25 thereof is expanded to the first inner diameter D1. Optionally borehole fluid can be pumped in the wellbore 20 below the expander 1 in order to prevent swabbing (i.e. the occurrence of an under-pressure in the wellbore) due to the movement of the expander 1.

Figure 5:
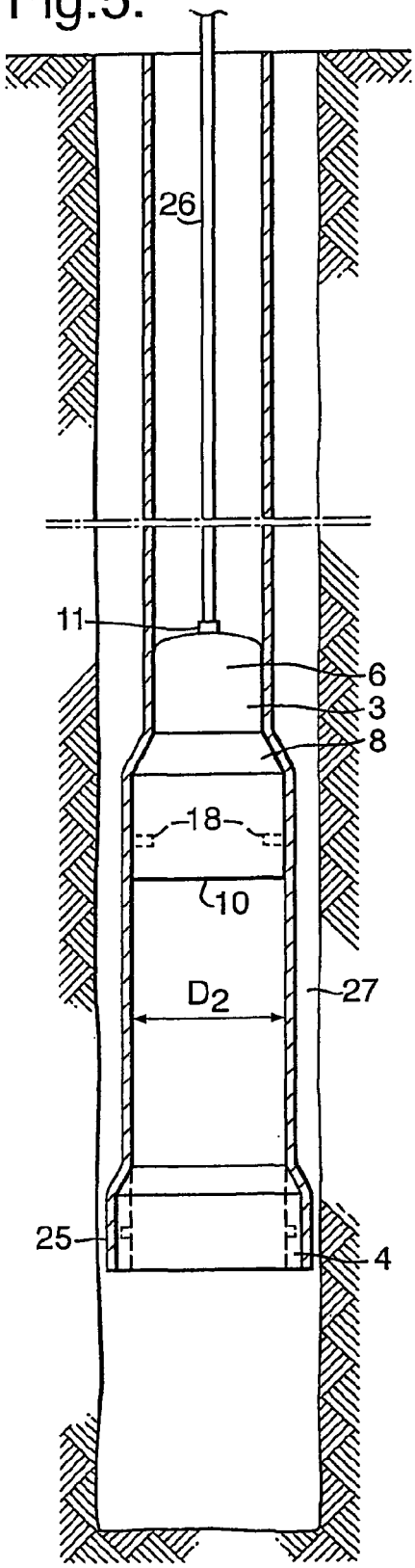
FIG. 5 schematically shows a third stage of the method of expanding a tubular string using the expander of FIG. 1A.

Referring further to FIG. 5, in a next step the hydraulic control system is induced to apply fluid pressure via the pulling string 26 to the hydraulic control means of the latching system 18 so as to unlatch the expander ring 4 from the main body 3 of the expander 1. Optionally, a ball could first be dropped through the pulling string 26 in order to create a flow path for hydraulic fluid to the latching system 18. Alternatively, such flow path could be created by means of a selected rotation of the pulling string 26.

Next the main body 3 is pulled further upwards by pulling string 26 while the expander ring 4 remains located in the lower end part 25 of the casing 24. The remaining part of the casing 24 is thereby expanded to the second inner diameter D2. The layer of cement present around the casing 24 hardens after the entire casing 24 has been radially expanded.

Figure 6:
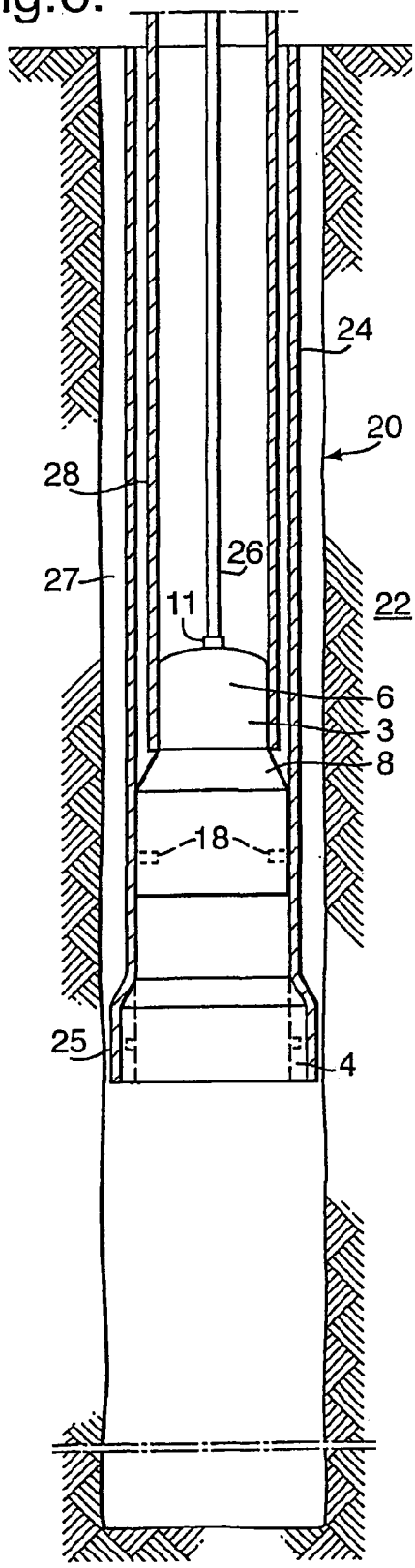
FIG. 6 schematically shows a fourth stage of the method of expanding a tubular string using the expander of FIG. 1A.

Reference is further made to FIG. 6. After the casing 24 has been expanded along the whole length thereof, the main body 3 of the expander 1 is removed through the upper end of the casing 24 and positioned at the lower end of a next casing 28 to be lowered into the wellbore 20. Hereinafter casing 24 is referred to as "the previous casing". The wellbore 20 is then drilled deeper until such depth that the next casing 28 can be installed in the wellbore.

The next casing 28 is subsequently lowered through the previous casing 24 whereby the main body 3 of expander 1 is suspended at the lower end of the next casing 28 by means of the pulling string 26. Lowering of the next casing 28 continues until the main body 3 enters into the expander ring 4. After the main body 3 has fully entered into the expander ring 4, the hydraulic control system at surface is induced to apply a selected fluid pressure to the hydraulic control means of the latching system 18 so as to latch the main body 3 to the expander ring 4. Similarly as described with respect to the previous casing 24, a ball could first be dropped into the pulling string 26 to create a flow path for hydraulic fluid to the latching system 18.

Figure 7:
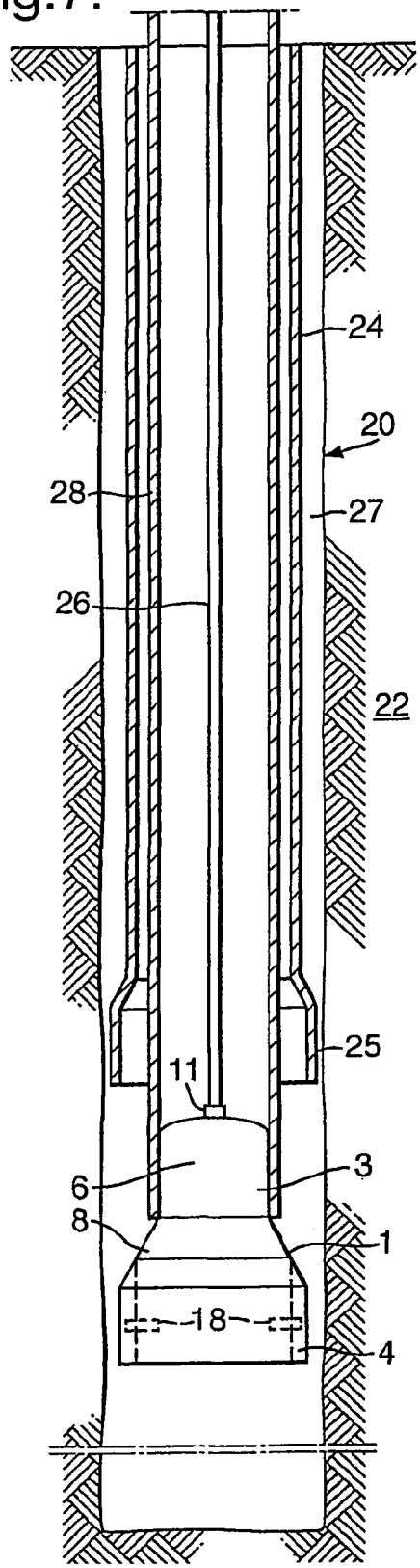
FIG. 7 schematically shows a fifth stage of the method of expanding a tubular string using the expander of FIG. 1A.

Reference is further made to FIG. 7. After latching of the main body 3 to the expander ring 4 the next casing 28 is further lowered through the previous casing 24, and as a result the expander ring 1 moves out of the lower end part of the previous casing 24.

Figure 8:
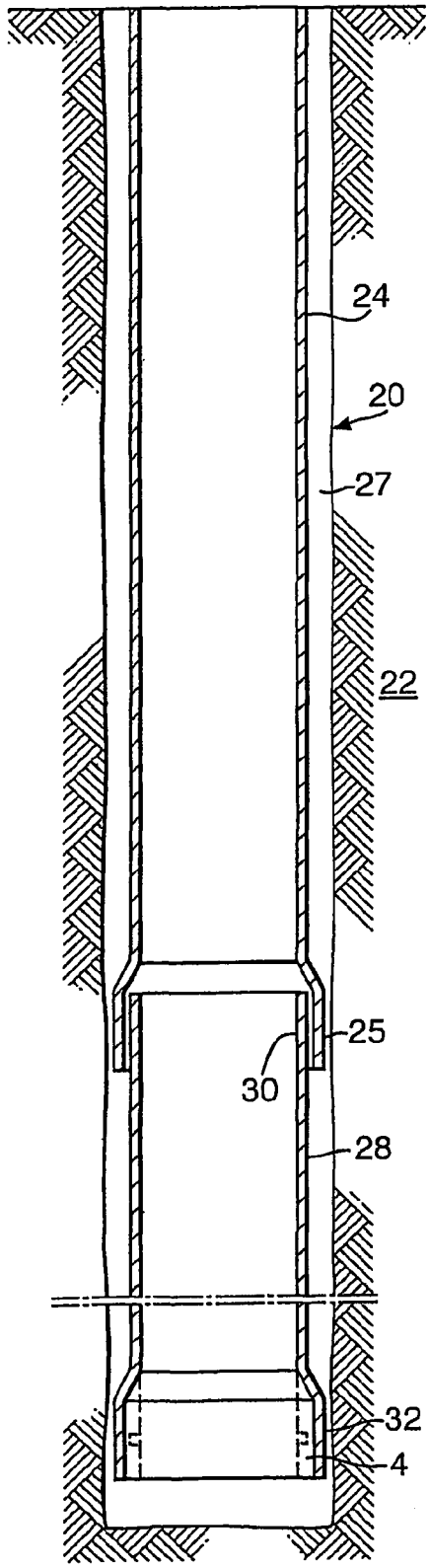
FIG. 8 schematically shows a sixth stage of the method of expanding a tubular string using the expander of FIG. 1A.

Reference is further made to FIG. 8. Lowering of the next casing 28 continues until an upper end part 30 of the next casing 28 is arranged in the lower end part 25 of the previous casing 24. Thereafter cement is pumped into the annular space 27 between the next casing 28 and the wall of the wellbore 20, which cement is similar to the cement pumped around the previous casing 24. Optionally the cement can be pumped via the small annulus between the upper end part 30 of the (yet unexpanded) next casing 28 and the lower end part 25 of the previous casing 24.

Subsequently the next casing 28 is radially expanded in a manner similar to expansion of the previous casing 24 whereby a lower end part 32 of the next casing 28 is expanded to inner diameter D1 and the remaining part of the next casing 28 is expanded to inner diameter D2. Similarly to the expansion process of casing 24, the expander ring 4 remains in the lower end part 32 of the next casing 28 while the remaining part of the next casing 28 is expanded. The layer of cement present around the next casing 28 hardens after the entire casing 28 has been radially expanded.

The process of further drilling and casing the wellbore 20 is then repeated in the manner as described with reference to FIGS. 6–8 until the wellbore reaches its final depth.

Instead of connecting the pulling string to the expander by means of the connector, suitably the pulling string passes through a bore of the expander and be provided with a nut at the rear end of the expander. Also, the pulling string could be screwed to the expander.

In the detailed description above a hydraulically operated latching system latches the expander ring to the main body. The expander ring could also be connected to the main body by purely a mechanical system (i.e. without hydraulic control) such as a J-slot.

Instead of using retarted cement which hardens only after a prolonged period of time, a cement could be used in combination with a hardener which is released into the annular space upon (and triggered by) expansion of the casing.

In general it will be necessary to anchor each next casing in the wellbore during pulling of the expander therethrough. Such anchoring could be done by means of a slip-arrangement arranged in the previous casing and at the top end part of the next casing. Furthermore, it is to be accounted for that in general the casing shortens during its radial expansion.

Instead of pulling the expander through the tubular element by means of a pulling string, the expander can be pumped through the tubular element using a suitable hydraulic fluid.

In the detailed description above the term "casing" has been used throughout, however the term "liner" can equally be used. In this respect the frequently used terminology of "casing" for a tubular element, which extends to surface, and "liner" for a tubular element which extends only in a lower part of the wellbore, is to be disregarded.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A method of radially expanding a tubular element extending into a wellbore, the tubular element having a first section to be expanded to a first diameter and a second section to be expanded to a second diameter, the first diameter being larger than the second diameter, the method comprising the steps of:

a) arranging an expander in the wellbore, the expander including a first expander member and a second expander member, wherein the first member has a larger outer diameter than the second member, said members being releasably interconnected;

b) moving the expander through the first tubular section so as to expand the first tubular section to the first diameter;

c) releasing the second expander member from the first expander member; and d) moving the second expander member through the second tubular section so as to be expanded to the second diameter.

2. The method of claim 1, wherein the first tubular section is a lower end part of the tubular element, and the second tubular section is the remaining part of the tubular element.

3. The method of claim 2, wherein the tubular element is a previous tubular element and wherein the tubular string includes a next tubular element, the method further comprising:

e) after step d) lowering the next tubular element through the previous tubular element until an upper end.

4. The method of claim 3, wherein said upper end part of the next tubular element is expanded to substantially the second diameter.

5. The method of claim 3, wherein the first expander member remains in the lower end part of the previous tubular element, and wherein the next tubular element is provided at the lower end thereof with the second expander member, the method further comprising:

f) upon passage of the second expander member through the lower end part of the previous tubular element, connecting the second expander member to the first expander member;

g) before step f), moving the expander through a lower end part of the next tubular element so as to expand said lower end part of the next tubular element to substantially the first diameter;

h) releasing the first expander member from the second expander member; and i) moving the second expander member through the remaining part of the next tubular element so as to expand said remaining part to substantially the second diameter.

6. The method of claim 5, wherein a plurality of said next tubular elements are expanded in the wellbore, and wherein steps e)–i) are repeated for each set of adjacent tubular elements.

7. The method of claim 1, wherein said expander members are interconnected by a latching system.

8. The method of claim 1, wherein the tubular element is a casing string of the wellbore.

* * * * *